United States Patent [19]

von Matuschka et al.

[11] Patent Number: 4,715,812

[45] Date of Patent: Dec. 29, 1987

[54] KILN FURNITURE

[75] Inventors: Alfred G. von Matuschka, Sauerlach-Altkirchen; Klaus Liethschmidt, Frechen-Grefrath; Hubertus Webert, Kerpem-Horrem; Emil K. Köhler, Berchtesgaden-Oberau, all of Fed. Rep. of Germany

[73] Assignee: Elektroschmelzwerk Kempten GmbH, Munich, Fed. Rep. of Germany

[21] Appl. No.: 854,046

[22] Filed: Apr. 21, 1986

[30] Foreign Application Priority Data

May 8, 1985 [DE] Fed. Rep. of Germany ..... 3516490

[51] Int. Cl.[4] ..... F27B 21/00

[52] U.S. Cl. ..... 432/258; 432/259; 264/57

[58] Field of Search ..... 432/258, 259; 264/57–59

[56] References Cited

U.S. PATENT DOCUMENTS

| | | | |
|---|---|---|---|
| 1,877,424 | 9/1932 | Fear | 432/259 |
| 3,958,924 | 5/1976 | Egenolf et al. | 432/258 |
| 3,997,289 | 12/1976 | Bowers | 432/259 |
| 4,184,840 | 1/1980 | Gamberg et al. | 432/259 |
| 4,362,507 | 12/1982 | Antonucci | 432/259 |
| 4,405,300 | 9/1983 | Lubowsky et al. | 432/258 |
| 4,462,798 | 7/1984 | Foster | 264/58 |
| 4,504,224 | 3/1985 | Hewitt | 432/258 |

*Primary Examiner*—Henry C. Yuen

*Attorney, Agent, or Firm*—Burgess, Ryan & Wayne

[57] ABSTRACT

Kiln furniture for supporting ceramic products to be baked in a high-speed baking kiln includes an inorganic fibrous material needled blanket having a plurality of depressions therein, and a plurality of separate basic bodies of a ceramic material mounted in the depressions and forming an upper emplacement surface for supporting the ceramic products.

8 Claims, 15 Drawing Figures

KILN FURNITURE

BACKGROUND OF THE INVENTION

The present invention relates to kiln furniture for holding ceramic products to be baked in high-speed backing kilns, and particularly, is directed to kiln furniture composed of a ceramic base material having a stack-up surface in contact with the conveyor or tunnel cars of the kiln and an emplacement surface for the ware. The kiln furniture can be advantageously used in different high-speed kilns where quite different conveyors, and even roller trains, are provided.

Most ceramic products, and especially fine ceramic products, such as procelain, are baked on or in kiln furniture at elevated temperatures. The baking takes place in baking apparatus, such as tunnel kilns, of different constructions. The kiln furniture, such as plates and pillars, are mounted in stories or layers on tunnel cars, the ware appearing in the individual stories, repeatedly stacked one upon the other. It is also known to use saggars having dimensions which are especially adapted to the dimensions of the ware.

Most conventional baking processes require long kiln cycles from cold to cold, even in the case of relatively short shift periods. Because of this, and together with the obvious disadvantage of the great energy requirement of such tunnel kilns, it is not possible or practical to automate the feeding and removel of ceramic products from the tunnel car, due to the multiplicity of ceramic products to be baked, and espcially due to the story-like mounting on the tunnel cars.

The kiln construction industry already has for a long time taken into account this situation and developed so-called high-speed baking kilns. Unlike traditional tunnel kilns, these high-speed kilns are not lined with heavy refractory materials of great heat-retaining capacity and very thick walls, but are essentially lined with ceramic fibrous materials. These novel refractory building materials, in fiber or wool form, have the advantages of high insulating capacity and therewith low energy consumption of the kiln, and low heat-retaining capacity and therewith low loss of energy when the kiln is started or brought to speed. Also, due to their fibrous structure, there is an extraordinarily high resistance to temperature change. These advantages of ceramic fibrous materials are utilized in high-speed backing kilns through which ceramic products pass in extremely short shift periods of time in a single layer, that is, not in the aforementioned story-like arrangement. However, these high-speed kilns, as a consequence of their specific advantages, must not be driven in a continuous operation, although they can be periodically switched on and off without great energy losses.

Exhaustive tests and research have shown that most ceramic products, especially fine ceramic products, can be baked per se without qaulity damage much more quickly than had formerly been possible. However, this has not been possible from a practical point of view, because the known kiln furniture is unable to cope with the hard operating conditions of high-speed kilns, particularly on account of insufficient resistance to temperature change. Despite considerable efforts, it has not hitherto been possible to improve the resistance to temperature change of already known kiln furniture, which are composed mainly of cordierite or silicon carbide. As a result, such known kiln furniture has not been economically employable in high-speed baking kilns.

OBJECTS AND SUMMARY OF THE INVENTION

Accordingly, it is an object of the present invention to provide kiln furniture having a high resistance to temperature change required for high-speed kilns, so as to open the possibility of now baking in high-speed kilns, at a much more reasonable cost and more quickly, many ceramic products which formerly were specially baked in tunnel kilns.

In accordance with an aspect of the present invention, kiln furniture for supporting ceramic products to be baked in a high-speed baking kiln, includes a support having a stack-up surface in contact with a conveyor of the kiln, the support being made of a ceramic basic material; and a plurality of separate basic bodies mounted on the support and forming an emplacement surface for supporting the ceramic products.

In accordance with another aspect of the present invention, kiln furniture for supporting ceramic products to be baked in a high-speed baking kiln, includes a support having a stack-up surface in contact with a converyor of the kiln, the support being made of a ceramic basic material; and a refractory coating on an upper surface of the support and forming an emplacement surface for supporting the ceramic products.

The above and other, objects, features and advantages of the present invention will become readily apparent from the following detailed description thereof which is to be read in connection with the accompanying drawings.

DETAILED DESCRIPTION OF THE PREFERRED EMBODIMENTS

Figure 1:
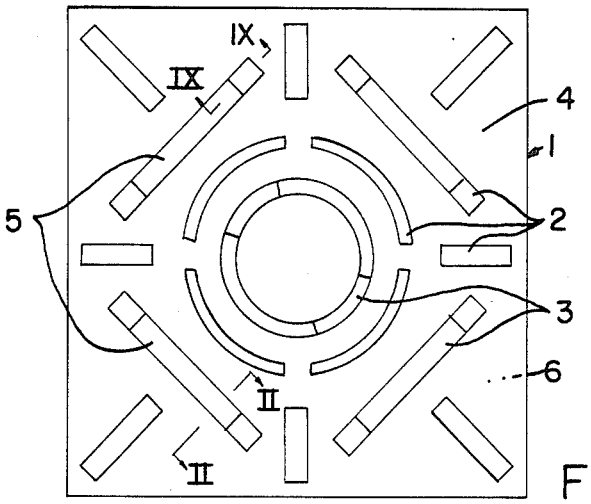
FIG. 1 is a top plan view of kiln furniture according to one embodiment of the present invention.

According to the present invention, the aforementioned advantages are obtained by constructing the kiln furniture in multiple parts. The invention departs from known kiln furniture which always consisted of a baked ceramic material, that is, in the form of solid bodies, which were closely adapted in their dimensions, often the same in the case of a complicated contour, to the measurements of the ware. For example, capsules for baking plates were given larger dimensions than the plate to be baked and the stresses occurring in the capsule under temperature changes led to the known disadvantage that this kiln furniture lasted only a few kiln cycles. The instant invention follows an entirely new course in the sense that the kiln furniture is composed of multiple parts and the individual parts include absolutely different materials. Thus, the kiln furniture according to the present invention is, as a rule, composed of an inorganic fibrous material in the form of a binder-free needled blanket or in the form of a needled blanket impregnated with an inorganic binder, which constitutes the stack-up surface, and of a ceramic material in the form of segment-like basic bodies and/or in the form of a refractory coating, which consitutes the emplacement surface. The blanket has a relatively large-surfaced shape, which nevertheless, is not disadvantageous owing to the high thermoshock resistance of the fibrous material.

According to one embodiment, the kiln furniture includes a blanket forming the stack-up surface and several rod-shaped or segment-like basic bodies of ceramic material, which are held in positional stability in grooves, slots or other depressions of the fibrous material, and together, form the emplacement surface for the ware. The blanket serves several functions. First, it insulates the conveyor form the baking area, and second, it allows the coordination with positional stability of the individual basic bodies of baked ceramic material so that the basic bodies together form the emplacement surface for the ware. The basic bodies of baked ceramic material have relatively small dimensions and a simple shape so that they are themselves in position to resist thermoshock conditions. Thus, the basic bodies can also have thin walls. It is even possibly advantageous to use ceramic materials which had hitherto been regarded as inadequate for the preparation of kiln furniture. However, it is important that the basic bodies absolutely need no longer have their dimensions and shapes adjusted to the dimensions and shapes of the wares. The only condition is that the basic bodies must together form a sufficiently stable emplacement surface for the ware.

The blanket can be easily produced with a stability such that the basic bodies, even when loaded with the ware, scarcely sink into the fibrous material, and thus, the emplacement surface for the ware remains to a large extent stable. Thus, it is possible, for instance, that the blanket, and particularly, a binder-free needled blanket, is impregnated with an inorganic binder such as monoaluminum phosphate, especially in a high-speed kiln where the baking is carried out mostly in one layer so that the weight exerted on the blanket by the basic bodies and the ware is limited. This peculiarity of one-layer baking in high-speed kilns is therefore advantageously complemented with the new kiln furniture and allows use of the blanket as a component part of the kiln furniture.

On the other hand, the new kiln furniture in combination with high-speed baking kilns brings about the further advantage that the feeding and removal of the ware can be automated in a simple manner. In the case of a changing ware, there results the possibility not only of automatically feeding and removing the ware proper, but also of automatically placing the basic bodies at the right place upon the blanket and, for instance, of setting up the ware in a second charging station. It is also possible to replace the entire kiln furniture including the blanket when the ware changes or to store it with the basic bodies left therein until the baking of the like or similar ware appears again. If the blankets are made flexible instead of stiff, such kiln furniture, including the basic bodies, can also be rolled up for storage. The size of the blanket can be adapted to the size of the individual ceramic product to be baked or also to the size of the conveyor in the kiln, so that a mat that passes through the whole plateau of a kiln car can be easily used. Finally, it is an added advantage that damaged basic bodies, which certainly form only a component part of the kiln furniture, can be easily replaced at a reasonable cost, and the blanket and other basic bodies as a rule can be still used.

The basic bodies conveniently have a cross section not susceptible to thermoshock, and particular, a rectangular, T-shaped, U-shaped, or I-shaped cross section, and have a limited length. The basic bodies as a rule have walls of slight thickness in order that they can be quickly heated and also quickly cooled without there appearing in them thermal stresses that destroy the basic bodies. If the emplacement surface of a basic body is too small for the contemplated use, several basic bodies of that kind in the form of thin plates, for instance, can be inserted side by side in a depression of the blanket. The basic bodies can at the same time have a wall thickness of 0.5 to several millimeters and be only a few centimeters long, or can be built, for instance, as thin carrier plates 3 cm wide, which likewise must be only a few centimeters long. It is naturally convenient to give the basic bodies a cross-section so that they can be produced at reasonable cost as mass products in an extrusion process.

The basic bodies can be inserted in the blanket with their emplacement surface projecting above the blanket. In this matter, the wares do not come directly into contact with the blanket, which could lead to an adherence of the blanket material to the ware. In the case of wares of special shapes, such as those provided with contact feet, the emplacement surface formed by the basic bodies can lie flush with the surface of the blanket or even below the surface.

The blanket can have a field or a matrix of grooves, slots or other depressions to be optionally used for insertion of the basic bodies, so that there will specially result thereby the possibility of automated grouping for the kiln furniture itself and automated feeding of the ware, and also the corresponding removal from the onveyor at the end of the high-speed baking kiln. It thereby becomes possible to carry out program-controlled grouping of the kiln furniture and relining of the same.

If the basic bodies are not held sufficiently, or with sufficient positional stability in all directions, in the grooves, slots, or other depressions, by the inherent elasticity of the blanket and/or the limitation of the grooves, it is possible to provide within the grooves, slots and other depressions corresponding indentations, nubs, or the like, so that through the feeding or insertion of a basic body, it is held on the blanket with positional stability in all directions, and thus, in precise position. Instead of the indentations, perforations, nubs and the like, it is also possible to secure the basic bodies on the blanket by gluing in order to achieve positional stability.

The kiln furniture composed of several parts according to the present invention consists of a fibrous material on a base of alumina and of segment-like ceramic basic bodies on a base of silicon carbide, aluminum silicate or alumina.

According to another embodiment of the kiln furniture comprised of several parts according to the present invention, the kiln furniture can also consist of a blanket, which instead of the line-up, or in addition to the line-up with the segment-like ceramic basic bodies, is provided with a refractory coating. It is possible here likewise to use a fibrous material on a base of alumina, advantageously in the form of a needled blanket impregnated with an inorganic binder such as monoaluminum phosphate, and then dried. As refractory coatings, there are preferably used those on a base of silicon carbide or alumina. These coatings are applied in a conventionally known manner by immersion, spraying, rolling, or coating, for instance, in the form of a mixture of 85% by weight SiC or $Al_2O_2$
10% by weight clay and
5% by weight monoaluminum phosphate liquefied with water. After application, these coatings are dried and then refractorily baked. To prevent flattening of the refractory coatings, it is advantageous, after the drying and prior to the baking, to provide the coating with a pattern of notches or indentations, for example, with a system of notches extending at right angles to each other or with punched hexagonal patterns.

Referring initially to FIG. 1, a piece of kiln furniture according to the present invention is composed of several parts, and includes a laminar support or blanket 1 of ceramic fibrous material, which can have either a board-like stiff structure or a flexible yielding structure, so that blanket 1 is elastically deformable to a limited extent. The size of blanket 1 is preferably adapted to the ceramic product to be baked or to the size of the conveyor in the high-speed kiln. Blanket 1 is axially symmetrically constructed in the embodiment shown in FIG. 1, and has a number of depressions 2 in the form of grooves or slots arranged and distributed, for example, in a circle or extended in a straight line. Depressions 2 preferably extend to a certain depth in the material of blanket 1 although, in exceptional cases, a depression 2 can also be provided continuously passing through the entire thickness of the fibrous material of blanket 1, as shown in FIG. 4.

Basic bodies 3 of a baked ceramic material and shaped as rods or segments, having a relatively simple cross-sectional configuration with a small wall thickness, are inserted in depressions 2, such that they project upwardly therefrom, as shown in FIG. 2–9. Together, basic bodies 3 form an emplacement surface 5 for supporting the ware. In a given blanket 1, however, not all depressions 2 must indispensably be occupied by basic bodies 3. Rather, it is sufficient to select certain basic bodies 3 in such a manner as is convenient and necessary for superimposing the ware concerned.

The underside of blanket 1 forms a stack-up surface 6 of the kiln furniture by which the kiln furniture is deposited on the conveyor, such as a wagon or a platform of a high-speed kiln. Blanket 1 thereby constitutes a certain insulating protection for the conveyor of the kiln and forms a base or support on which the individual basic bodies 3 are erected and held in positional stability to each other, as is required for superimposing the ware.

Figure 2:
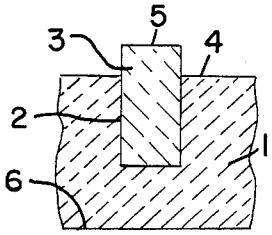
FIG. 2 is a cross-sectional view, taken along line II—II of FIG. 1, showing a depression and basic body according to one embodiment of the present invention that can be used with the kiln furniture of FIG. 1.
Figure 3:
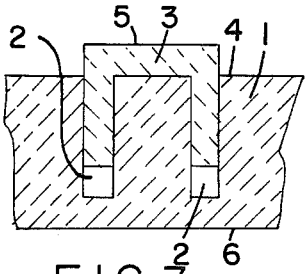
FIG. 3 is a cross-sectional view, taken along line II—II of FIG. 1, showing depressions and a basic body according to another embodiment of the present invention that can be used with the kiln furniture of FIG. 1.
Figure 4:
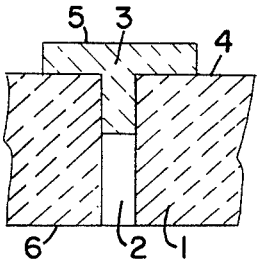
FIG. 4 is a cross-sectional view, taken along line II—II of FIG. 1, showing a depression and basic body according to another embodiment of the present invention that can be used with the kiln furniture of FIG. 1.

Referring now to FIGS. 2–8, there are shown different embodiments of depressions 2 and basic bodies 3, taken in cross-section along line II—II of FIG. 1, that can be used with the kiln furniture according to the present invention. Specifically, FIG. 2 shows a simple rectangular cross-section of a basic body 3 that is inserted upright in a similarly configured depression 2. FIG. 3 shows an inverted U-shaped cross-section of a basic body 3 inserted in two depressions 2. Depressions 2 are made deeper than the legs of basic body 3 so that basic body 3 rests on upper suface 4 of blanket 1 between the two slotlike depressions 2. FIG. 4 shows a depression 2 extending continuously through the thickness of blanket 1, and a basic body 3 of a T-shaped cross-section, which can easily be produced in an extrusion process.

Figure 5:
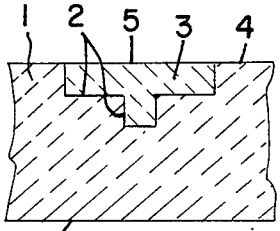
FIG. 5 is a cross-sectional view, taken along line II—II of FIG. 1, showing a depression and basic body according to another embodiment of the present invention that can be used with the kiln furniture of FIG. 1.
Figure 6:
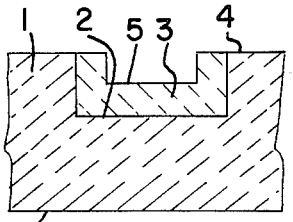
FIG. 6 is a cross-sectional view, taken along line II—II of FIG. 1, showing a depression and basic body according to another embodiment of the present invention that can be used with the kiln furniture of FIG. 1.

In the embodiment of FIG. 5, basic body 3 is likewise of a T-shaped cross-section, and is inserted in a similarly configured depression 2 in such a manner such that emplacement surface 5 of basic body 3 is aligned or flush with upper surface 4 of blanket 1. According to the embodiment of FIG. 6, emplacement surface 5 of the basic body 3 shown, is situated lower than the upper surface 4 of blanket 1, although the upper ends of the legs of U-shaped basic body 3 are flush with upper surface 4. It is obvious that the embodiments of FIGS. 5 and 6 are coordinated with the ware to be accommodated in such a manner such that the ware does not come into contact with the upper surface 4 of blanket 1.

Figure 7:
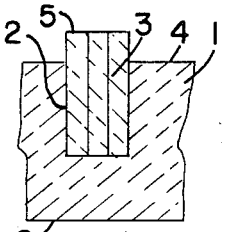
FIG. 7 is a cross-sectional view, taken along line II—II of FIG. 1, showing a depression and basic body according to another embodiment of the present invention that can be used with the kiln furniture of FIG. 1.

FIG. 7 shows an embodiment similar to that of FIG. 2, but the basic body 3 here consists of three single flat plates of a very small wall thickness, which are adjusted side by side in a group, in a depression 2.

Figure 8:
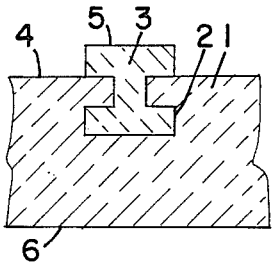
FIG. 8 is a cross-sectional view, taken along line II—II of FIG. 1, showing a depression and basic body according to another embodiment of the present invention that can be used with the kiln furniture of FIG. 1.

The kiln furniture according to the embodiment of FIG. 8 has a blanket 1 with a groove-like undercut or inverted T-shaped depression 2 in which a basic body 3 of an I-shaped cross-section is inserted. Such an embodiment is especially convenient when a flexible blanket 1 is used and the entire kiln furniture is stored, for instance, by rolling it up, until the corresponding ware has to be baked again.

Figure 9:
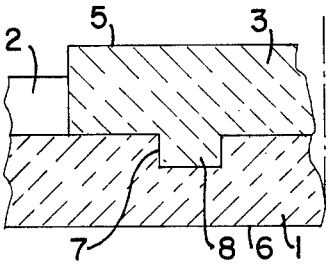
FIG. 9 is a cross-sectional view, taken along line II—II of FIG. 1, showing a depression and basic body according to another embodiment of the present invention that can be used with the kiln furniture of FIG. 1.
Figure 10:
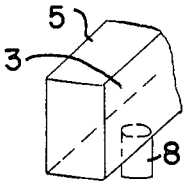
FIG. 10 is a perspective view of a portion of the basic body of FIG. 9.
Figure 11:
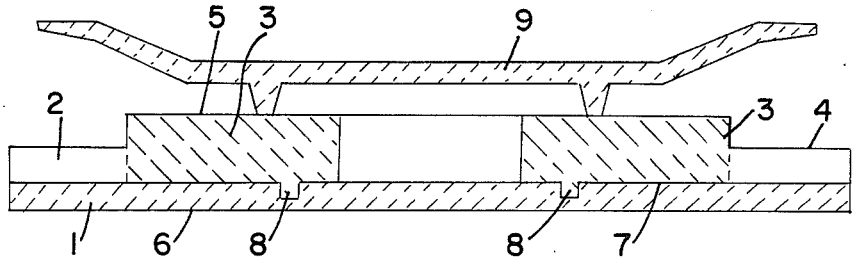
FIG. 11 is a cross-sectional view of kiln furniture according to another embodiment of the present invention, with a ware superimposed thereon.

As shown in FIGS. 1 and 9, the length of each depression 2 does not necessarily have to coincide with the length of the corresponding basic body 3. A depression 2 can, to the contrary, be made longer than a basic body 3, and can also be provided as continuously extending over the entire width and/or length of blanket 1 so that a much shorter basic body 3 can be inserted at any desired point of the depression 2, and especially where it is precisely needed for depositing the ware. However, in order to prevent displacement of basic body 3 in the lengthwise direction of the depression 2, the depression 2 can be provided with an indentation 7 and the basic body 3 with one or more nubs 8 so that basic body 3 cannot move in the lengthwise direction in the respective depression 2. FIG. 10 shows a perspective view of a portion of the basic body 3 of FIG. 9, and FIG. 11 shows a cross-section through a piece of kiln furniture in which a plate 9 is superimposed as the ware.

Figure 12:
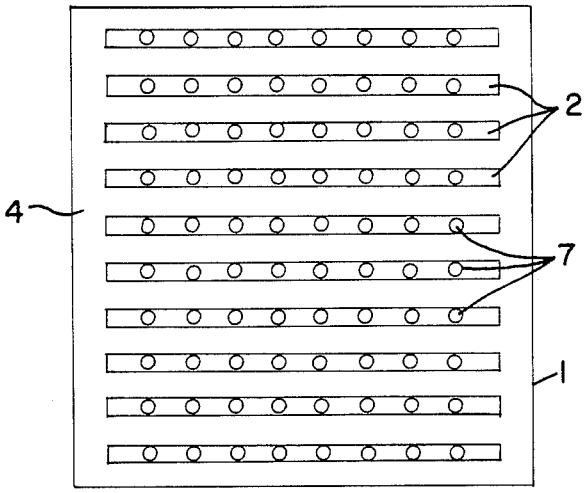
FIG. 12 is a top plan view of a blanket that can be used with kiln furniture according to the present invention.
Figure 13:
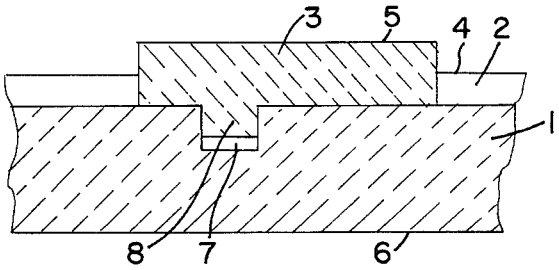
FIG. 13 is a cross-section view of the blanket of FIG. 12, with a basic body therein.

Referring now to FIG. 12 there is shown a top plan view of a blanket 1 in which the entire upper surface 4 is crossed by depressions 2 arranged in parallel lines, with circular indentations 7 being likewise situated in a regular arrangement in the depressions 2. In combination therewith, basic bodies 3 can be inserted, as shown in FIG. 13. By a relative rotation of a basic body 3 through 180 degrees prior to insertion in a depression 2, it is thus possible that the basic body 3 can be positioned to occupy any point of a line of the respective depression 2. This opens the possibility of automaticaly occupying, under programmed control, specific portions of individual lines of depressions 2 with basic bodies 3 and, for example, superimposing the ware thereon at a successive station. This is especially possible in high-speed kilns which are only charged in one layer. The removal at the kiln end can thus be automated.

Figure 14:
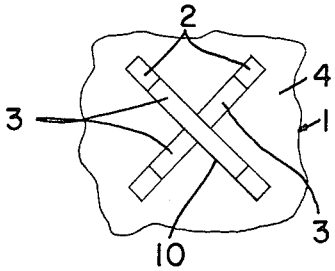
FIG. 14 is a top plan view of a portion of kiln furniture according to another embodiment of the present invention.

FIG. 14 shows a top plan view of another embodiment of kiln funiture according to the present invention, in which depressions 2 are formed as intersecting groove cuts, with three basic bodies 3 being inserted. With this embodiment, it is possible to superimpose a smaller, lighter object, usch as an egg-cup or a cup, as the ware. The individual basic bodies 3 can additionally be fixed in positional stability in depressions 2 by gluing, as at 10.

Figure 15:
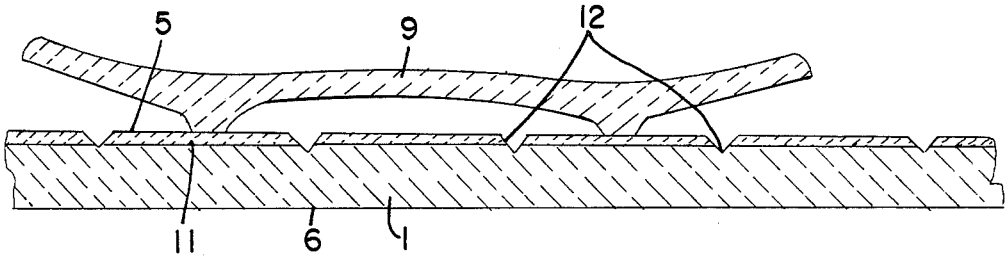
FIG. 15 is a cross-sectional view of kiln furniture according to another embodiment of the present invention.

FIG. 15 shows a cross-section through another embodiment of kiln furniture in which blanket 1 is provided with a refractory coating 11, the surface of which forms the emplacement surface 5 for the ware. As shown, coating 11 is perforated by cuts or notches 12 to prevent flattening of refractory coating 11 after drying, but prior to baking.

Having described specific preferred embodiments of the invention with reference to the accompanying drawings, it will be appreciated that the present invention is not limited to those precise embodiments, and that various changes and modifications can be effected therein by one of ordinary skill in the art, without departing from scope or spirit of the invention, as defined by the appended claims.

What is claimed is:

1. Kiln furniture for supporting ceramic products to be baked in a high-speed baking kiln, comprising:

a laminar support including a needled blanket impregnated with an inorganic binder or a binder-free needled blanket, said blanket having a lower stack-up surface in contact with a conveyor surface of said kiln and an upper surface with a plurality of depressions in the form of preformed slots and/or grooves therein; and a plurality of separate segment-like basic bodies made of a ceramic material and fitted in said depressions on said blanket, said basic bodies being relatively small, having simple shapes and having cross-sections resistant to thermoshock, said basic bodies together forming an emplacement surface for supprting said ceramic products to be baked in said high-speed baking kiln.

2. Kiln furniture according to claim 1; wherein each of said basic bodies as a cross-sectional configuration of one of a rectangle, T-shape, U-shape and I-shape of limited length.

3. Kiln furniture according to claim 1; wherein said basic bodies are inserted in said depressions such that said emplacement surface projects above an upper surface of said support.

4. Kiln furniture according to claim 1; wherein said support has a field of depressions, and said basic bodies are selectively fit within said depressions.

5. Kiln furniture according to claim 4; wherein said depressions in said field are aligned with each other.

6. Kiln furniture according to claim 1; wherein said support is formed with a plurality of depressions, said plurality of basic bodies are mounted in said depressions, one of an indentation and nub is formed in each depression and the other of the indentation and nub is formed on a corresponding basic body for mating engagement therewith.

7. Kiln furniture according to claim 1; wherein said support includes a plurality of depressions, and said plurality of basic bodies are glued in said depressions.

8. Kiln furniture according to claim 1; wherein said support is formed of a fibrous material on a base of alumina and said basic bodies are formed on a base of at least one of silicon carbide, alimina silicate, and alumina.

* * * * *